US005903097A

United States Patent [19]

Lee

[11] Patent Number: 5,903,097

[45] Date of Patent: May 11, 1999

[54] METHOD OF MANUFACTURING A SIDE GLASS FOR A VACUUM FLUORESCENT DISPLAY

[75] Inventor: Yong-kyu Lee, Pusan-si, Rep. of Korea

[73] Assignee: Samsung Display Devices Co., Ltd., Kyungki-do, Rep. of Korea

[21] Appl. No.: 08/998,785

[22] Filed: Dec. 29, 1997

[30] Foreign Application Priority Data

Jul. 2, 1997 [KR] Rep. of Korea ..... 97-30641

[51] Int. Cl.[6] ..... H01J 1/62

[52] U.S. Cl. ..... 313/493; 65/34; 65/41; 65/42; 65/43; 65/55; 65/60.8; 65/104; 65/120; 156/102; 313/306; 313/512

[58] Field of Search ..... 65/34, 41, 42, 65/43, 55, 60.8, 104, 120; 156/102; 313/306, 582, 493, 512, 246, 268, 291, 292

[56] References Cited

U.S. PATENT DOCUMENTS

| | | | |
|---|---|---|---|
| 2,032,003 | 2/1936 | Clause | 65/58 |
| 2,342,609 | 2/1944 | Ellefson | 65/45 |
| 3,519,409 | 7/1970 | Stutzman | 65/40 |
| 3,701,918 | 10/1972 | Allen et al. | 313/582 |
| 3,839,002 | 10/1974 | Verhoeven et al. | 65/42 |
| 3,862,830 | 1/1975 | Stern | 65/58 |
| 3,995,941 | 12/1976 | Nagahara et al. | 349/154 |
| 4,051,404 | 9/1977 | Kupsky | 313/582 |
| 4,269,617 | 5/1981 | Shibuya et al. | 65/43 |
| 4,277,275 | 7/1981 | Kawamura et al. | 65/43 |
| 4,666,548 | 5/1987 | Eto et al. | 156/286 |
| 4,828,597 | 5/1989 | Glascock, II et al. | 65/42 |
| 4,934,975 | 6/1990 | Fritsch et al. | 445/30 |
| 5,145,437 | 9/1992 | Ondura et al. | 445/45 |
| 5,188,553 | 2/1993 | Dougherty | 445/8 |

*Primary Examiner*—Stanley S. Silverman
*Assistant Examiner*—Sean Vincent
*Attorney, Agent, or Firm*—Christie, Parker & Hale, LLP

[57] ABSTRACT

A method of manufacturing a side glass for a vacuum fluorescent display is provided wherein a glass is cut to a predetermined length in accordance with the size of the vacuum fluorescent display. The glass is then bent to coincide two ends of the glass in accordance with the shape of the vacuum fluorescent display, and the two ends of the glass are adhered to one another. A sealing frit is applied on the upper side of the glass, and is plasticized and cured.

9 Claims, 4 Drawing Sheets

METHOD OF MANUFACTURING A SIDE GLASS FOR A VACUUM FLUORESCENT DISPLAY

BACKGROUND OF THE INVENTION

The present invention relates to a method of manufacturing side glass for a vacuum fluorescent display (VFD), and more particularly, to a method of manufacturing the VFD more efficiently by manufacturing the side glass of the VFD with a simple and convenient process.

The vacuum fluorescent display (VFD) is a well known flat display device which displays an image on its screen by emitting hot electrons from its cathode made of a filament, controlling the movement of the hot electrons with grids, and irradiating the hot electrons to an anode plate on which fluorescent materials are coated.

A vacuum case, in which at least one side is transparent, is mounted on the VFD's external side, and an evacuation tube is conventionally formed on the vacuum case to extract air or gas from the vacuum case. Specifically, the vacuum case includes a base glass in which a circuit board is formed, a side glass which is mounted on the base glass, and a front glass which is mounted on the side glass. Conventionally, the evacuation tube is formed on the side glass, and after extracting gas or air from the vacuum case through the evacuation tube, the end of the evacuation tube is sealed.

However, the conventional VFD with the vacuum case has several disadvantages. That is, the evacuation tube is easily destroyed by external impact and the external appearance of the VFD is not aesthetically pleasing because part of the evacuation tube is exposed to the outside of the side glass.

Recently, VFD's have been formed with evacuation holes formed on the base glass to extract the gas or air from vacuum case instead of using the evacuation tube formed on the side glass. In these systems, after extracting the gas or air from the vacuum case through the evacuation hole with an evacuation device, such as a pump, the evacuation hole is sealed with a seal cap to maintain the vacuum formed in the vacuum case.

The VFD having the evacuation hole instead of the evacuation tube will be described with reference to FIG. 6. As shown in FIG. 6, the vacuum case of the VFD includes a base glass 1 in which the evacuation hole 10*a* is formed, a side glass 3 which is mounted on the edges of the base glass 1, and a front glass 5 which is mounted on the side glass 3. The base, side and the front glasses 1, 3, 5 are adhered to each other with a sealing frit (S-Frit). The seal cap 7 is attached beneath the base glass 1 to seal the evacuation hole 10*a* after extracting the gas or air from the vacuum case. The base glass 1 is produced by several processes including a circuit masking process. The side glass 3, which is made of four pieces of glass, is conventionally produced by the following process. Namely, the method for manufacturing the side glass 3 includes the steps of (1) cutting four pieces of glass at predetermined lengths, (2) cleaning the four pieces of glass, (3) adhering the four pieces of glass together in the shape of a rectangular box (side glass) with mounting frits (M-Frit), (4) coating a sealing frit on the upper side of the side glass, and (5) plasticizing the sealing frit and examining the side glass.

However, by adhering the four pieces of glass, the manufacturing process of the VFD is more complex. Furthermore, the four pieces of glass must be scribed and produced to have exactly same lengths with the lengths of the VFD. In addition, a large amount of the mounting frit is required to adhere the four pieces of glass, which increases the cost of manufacturing the VFD.

SUMMARY OF THE INVENTION

Accordingly, an embodiment of the present invention is directed to a method of manufacturing a side glass for a vacuum fluorescent display (VFD) which substantially obviates one or more of the problems due to the limitations and disadvantages of the related art. An object of an embodiment of the present invention is to provide a more efficient method of manufacturing a vacuum fluorescent display (VFD) by manufacturing the side glass of the VFD with reduced glass cutting processes and reduced glass adhering processes.

A further object of an embodiment of the present invention is to provide a method of manufacturing a side glass for a vacuum fluorescent display (VFD) which reduces the amount of mounting frit for adhering the glass, thereby reducing manufacturing costs of the VFD.

To achieve the above described objects, an embodiment of the present invention is a method of manufacturing a side glass for a vacuum fluorescent display (VFD) including the steps of cutting a glass to a predetermined length in accordance with the size of the vacuum fluorescent display. Bending the glass to coincide two ends of the glass in accordance with the shape of the vacuum fluorescent display. Adhering the two ends of the glass. Applying a sealing frit on the upper side of the glass, and plasticizing and curing the sealing frit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Preferred embodiments of the present invention will become apparent from a study of the following detailed description with reference to the accompanying drawings.

Figure 1:
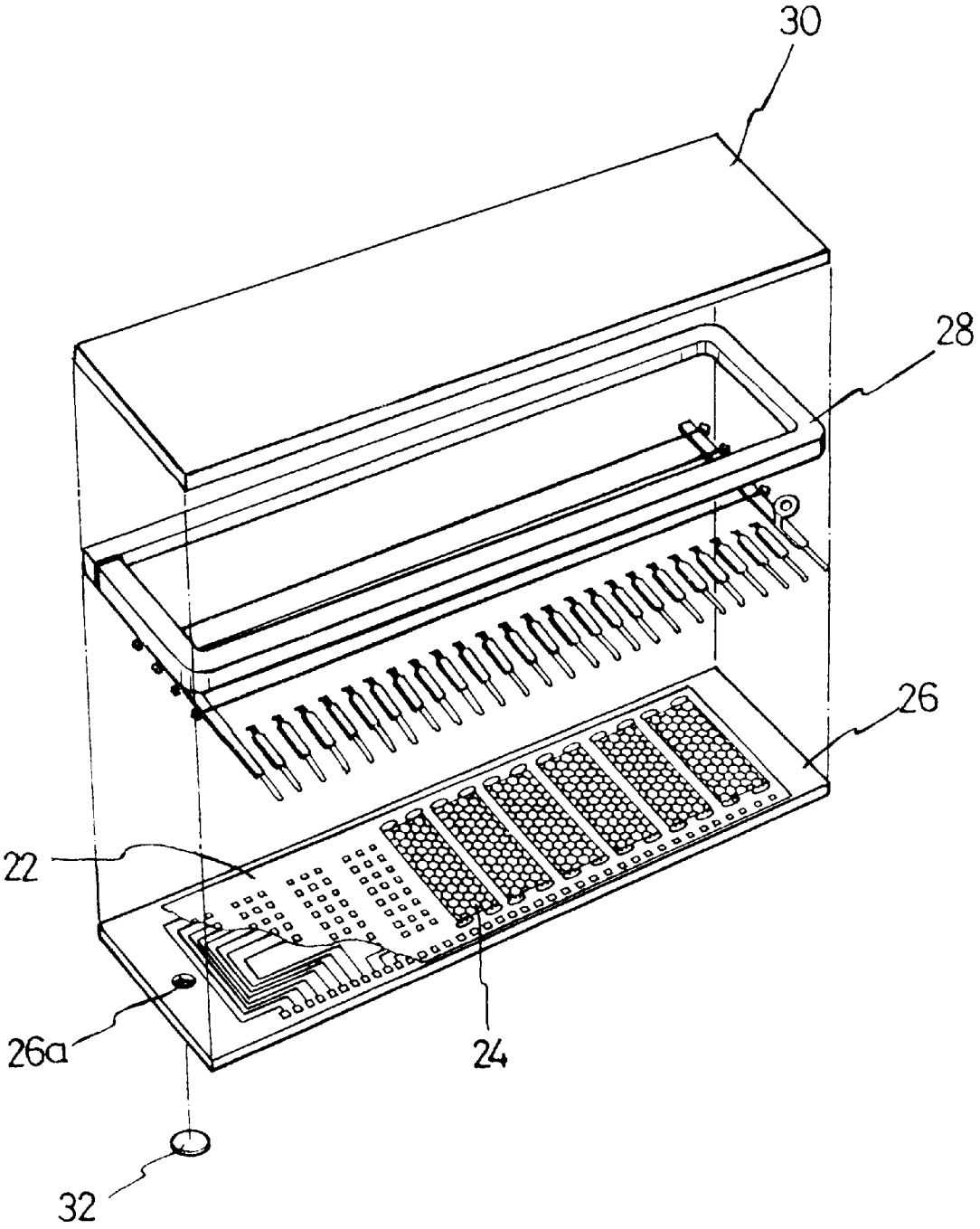
FIG. 1 is an exploded perspective view of the vacuum fluorescent display manufactured according to an embodiment of the present invention.

As shown in FIG. 1, the VFD according to an embodiment of the present invention includes a vacuum case consisting of a base glass 26 in which the anodes 22 and grids 24 are formed, a side glass 28 which is mounted on the edges of the base glass 26, and a transparent front glass 30 which is mounted on the side glass 28. The gas or air is extracted from the vacuum case through an evacuation hole 26*a* formed on the base glass 26, and then the evacuation hole 26*a* is sealed with a seal cap 32 to maintain a vacuum in the vacuum case. Roughly, the method of manufacturing the VFD includes the steps of masking processes, manufacturing the base glass, manufacturing the side glass, mounting process, sealing process and gas extracting process. An embodiment of the present invention provides an improved method of manufacturing the side glass, and thus the method of manufacturing the side glass will be described in detail.

Figure 2:
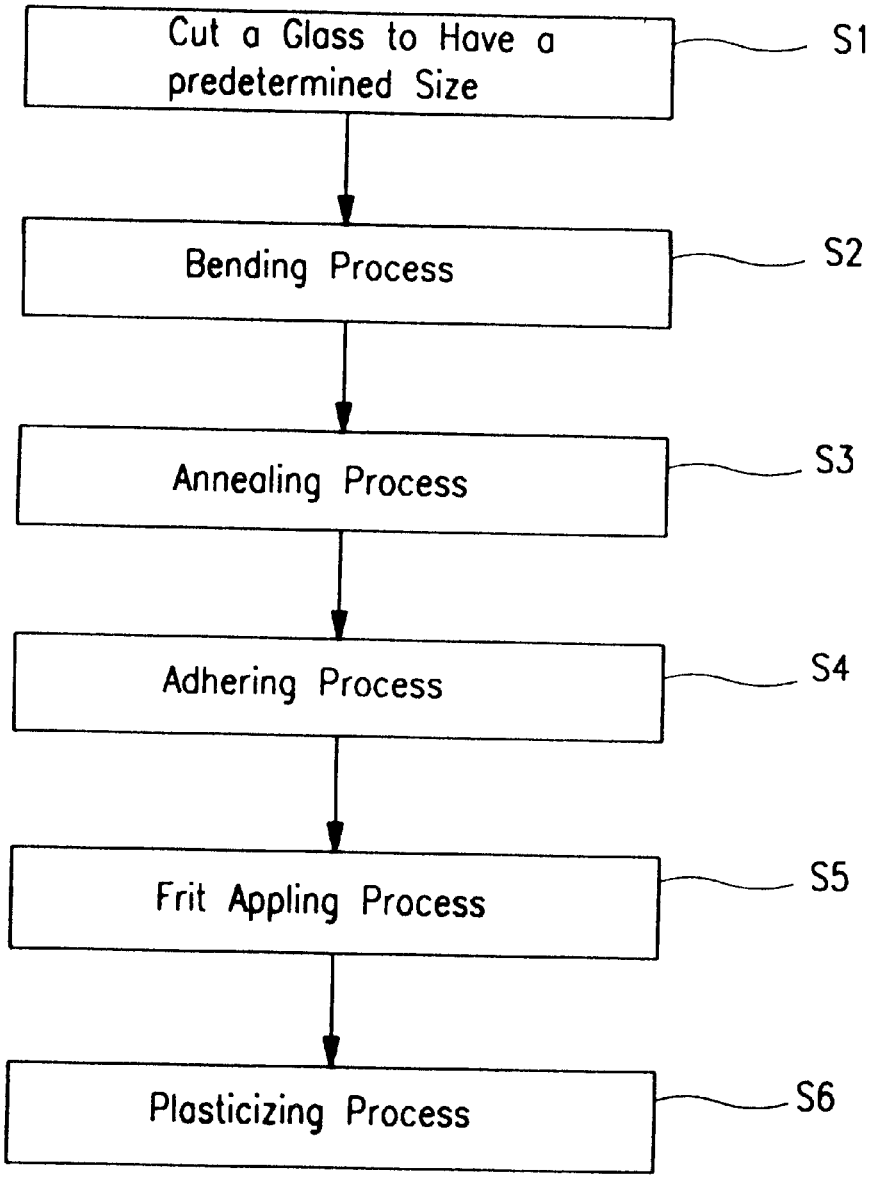
FIG. 2 is a flow chart illustrating the method of manufacturing the side glass for the VFD according to an embodiment of the present invention.
Figure 3:
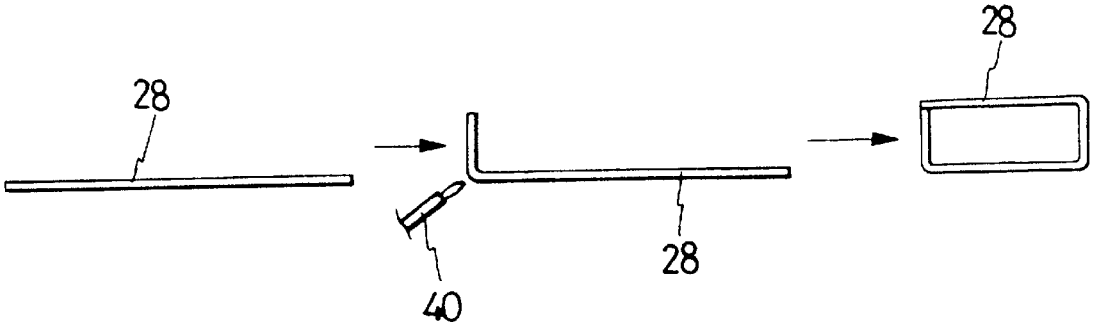
FIGS. 3 to 5 shows the method of manufacturing the side glass for the VFD according to an embodiment of the present invention.
Figure 4:
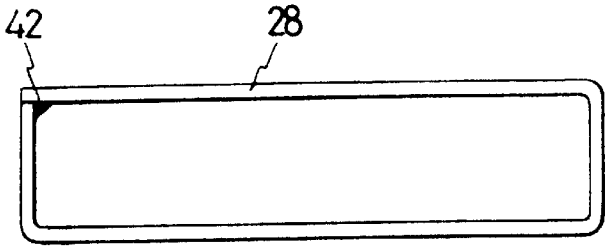
Figure 5:
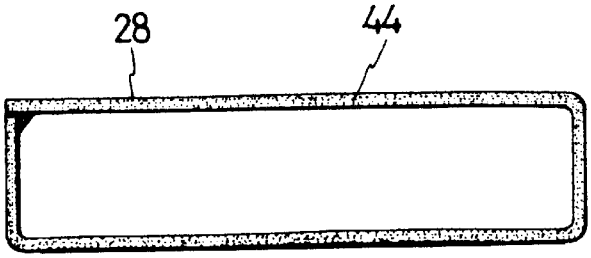
Figure 6:
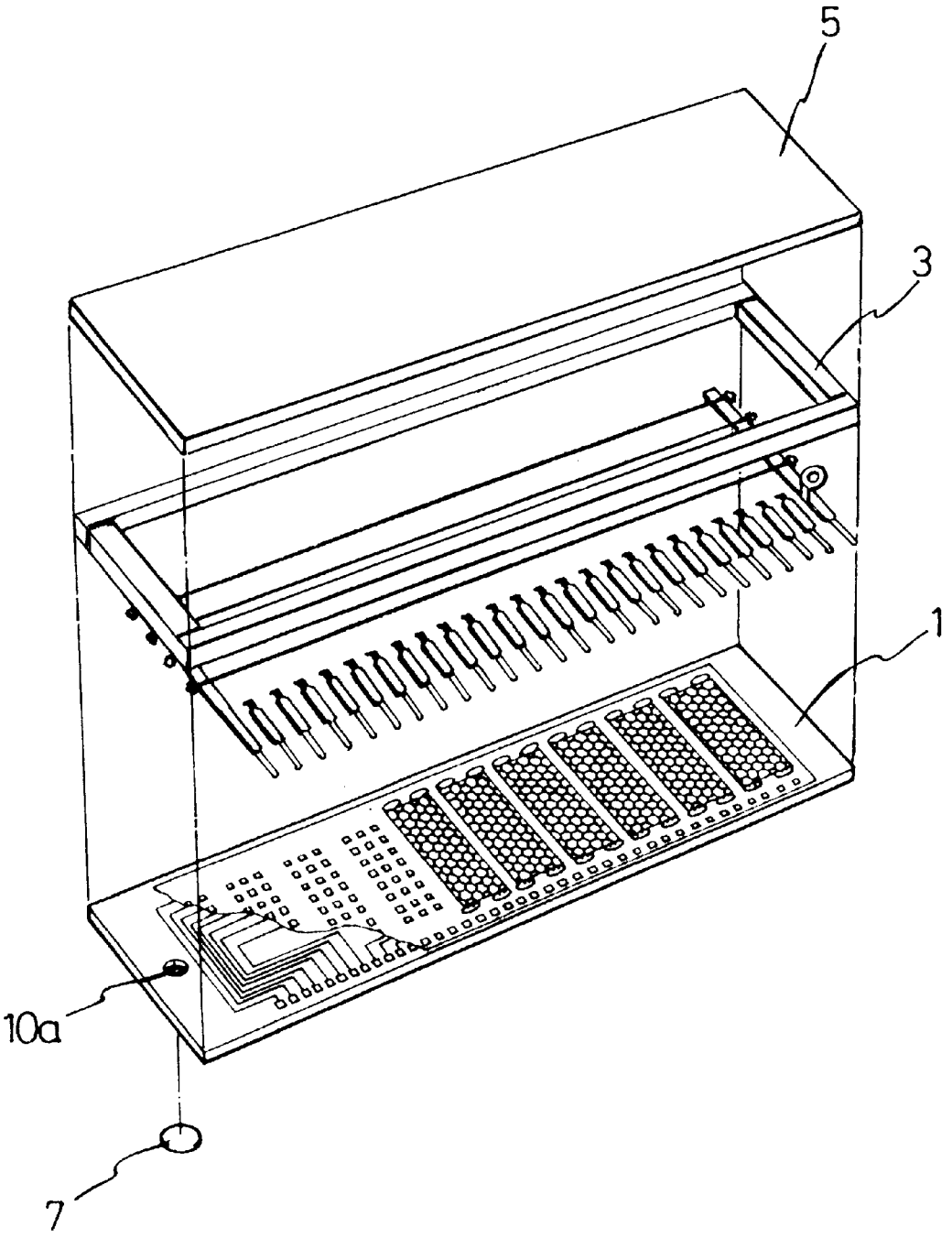
FIG. 6 PRIOR ART
FIG. 6 is an exploded perspective view of the vacuum display manufactured according to the conventional method.

As shown in FIG. 1, the side glass 28 is made from one piece of glass. As shown in FIG. 2, the first step of manufacturing the side glass 28 is to cut a line-shape glass at a predetermined length in accordance with the size of the VFD (S1) . The cutting process (S1), that is, a scribing process is performed in accordance with a conventional process. Then the side glass 28 is bent in accordance with the shape of the VFD (S2). Generally, the shape of the VFD is a rectangular box shape, thus the side glass 28 is bent to a rectangular shape. The bending process (S2) is preferably performed by heating three points of the side glass 28 with a heating device, such as a torch 40, as shown in FIG. 3. The side glass 28 is preferably bent so that the two ends of the side glass 28 coincide. However, when the side glass 28 is bent into the rectangular shape, stress is produced on the glass material at the bent positions, which causes deterioration of the glass. Therefore, an annealing process is required to eliminate the stress on the bent positions of the glass by heating the entire side glass 28 after the bending process (S3). The annealing process (S3) is performed by inserting the side glass 28 into a heating bath. After the annealing process S3, an adhering process is performed for adhering the two ends of the side glass 28. As shown in FIG. 4, the adhering process S4 is performed by attaching a sealing frit 42 on the position where the two ends of the side glass 28 coincide. Thus, the two ends of the side glass 28 are adhered by the sealing frit 42. After the adhering process, a sealing frit 44 is applied on the upper side of the side glass 28 (S5) as shown in FIG. 5. Thereafter, the sealing frit 44 is plasticized (S6) and thereby cured. Finally, the side glass 28 is examined and used for manufacturing the VFD.

As describe above, the method of manufacturing a vacuum fluorescent display (VFD) includes the method for manufacturing the side glass by bending the side glass and adhering the two ends of the side glass. Thus, according to an embodiment of the present invention, a more efficient method of manufacturing a vacuum fluorescent display (VFD) is provided since it is not required to adhere four pieces of the glass to produce the side glass. In addition, the cost for manufacturing the side glass is reduced because less sealing frit is required to adhere the side glass.

What is claimed is:

1. A method for manufacturing a side glass for a vacuum fluorescent display, comprising the steps of:

cutting a glass to a predetermined length in accordance with a size of the vacuum fluorescent display;

bending the glass to coincide two ends of the glass in accordance with a shape of the vacuum fluorescent display;

adhering the two ends of the glass;

applying sealing frit on an upper side of the glass; and plasticizing and curing the sealing frit.

2. A method for manufacturing a side glass for a vacuum fluorescent display according to claim 1 further comprising the step of annealing the glass to eliminate stress on the glass between the step of bending the glass and adhering the two ends of the glass.

3. A method for manufacturing a side glass for a vacuum fluorescent display according to claim 1 wherein the step of bending is performed by heating predetermined points of the glass.

4. A method for manufacturing a side glass for a vacuum fluorescent display according to claim 1 wherein the step of adhering is performed by applying a sealing frit to at least one of the two ends of the glass.

5. A method for manufacturing a side glass for a vacuum fluorescent display according to claim 1 wherein the bending step is performed by bending the glass into a shape of a rectangular box.

6. A method for manufacturing a side glass for a vacuum fluorescent display according to claim 3 wherein the step of heating is performed with a torch.

7. A method for manufacturing a vacuum fluorescent display, comprising the steps of:

preparing a side glass by cutting a glass to a predetermined length in accordance with a size of the vacuum fluorescent display, bending the glass to coincide two ends of the glass in accordance with a shape of the vacuum fluorescent display, and adhering the two ends of the glass;

forming a vacuum case by applying a first sealing frit between a base glass and a lower side of the side glass, applying a second sealing frit between a front glass and an upper side of the side glass, and curing the first and second sealing frits;

extracting gas or air from the vacuum case; and sealing the vacuum case.

8. A vacuum fluorescent display, comprising:

a base glass;

a side glass mounted on the base glass, said side glass being formed from a continuous glass which is bent to coincide two ends of the side glass in accordance with a shape of the vacuum fluorescent display, said two ends being adhered to one another; and a transparent front glass mounted on the side glass.

9. The vacuum fluorescent display of claim 8 wherein said side glass is frit sealed to the base glass and the front glass.

* * * * *